US005443022A

United States Patent [19]

Winkin et al.

[11] Patent Number: 5,443,022

[45] Date of Patent: Aug. 22, 1995

[54] FLUIDIZED BED REACTOR AND METHOD UTILIZING REFUSE DERIVED FUEL

[75] Inventors: Justin P. Winkin, Annandale; Walter R. Campbell, Jr., Union, both of N.J.; Stephen J. Goidich, Palmerton, Pa.; John Tang, Robbinsville, N.J.; Iqbal F. Abdulally, Randolph, N.J.; John W. Phalen, Somerville, N.J.

[73] Assignee: Foster Wheeler Energy Corporation, Clinton, N.J.

[21] Appl. No.: 314,832

[22] Filed: Sep. 29, 1994

Related U.S. Application Data

[62] Division of Ser. No. 064,776, May 11, 1993, Pat. No. 5,395,596.

[51] Int. Cl.[6] ..... F23G 5/00; F23G 7/00

[52] U.S. Cl. ..... 110/245; 122/4 D; 432/58; 165/104.16

[58] Field of Search ..... 110/244, 245, 255, 345, 110/343, 346, 300, 313; 122/4 D; 165/104.16; 432/58

[56] References Cited

U.S. PATENT DOCUMENTS

| | | | |
|---|---|---|---|
| 3,830,636 | 8/1974 | Marsh | 110/346 X |
| 4,208,386 | 6/1980 | Arand et al. | 423/235 |
| 4,940,006 | 7/1990 | Temelli | 110/244 X |
| 5,095,854 | 3/1992 | Dietz | 110/245 |
| 5,138,958 | 8/1992 | Sinquin et al. | 110/346 |
| 5,218,932 | 6/1993 | Abdulally | 110/245 X |
| 5,254,797 | 10/1993 | Imoto et al. | 110/346 X |
| 5,269,263 | 12/1993 | Garcia-Mallol | 122/4 D |
| 5,365,889 | 11/1994 | Tang | 110/245 X |

*Primary Examiner*—Denise L. Gromada
*Assistant Examiner*—Susanne C. Tinker
*Attorney, Agent, or Firm*—Marvin A. Naigur

[57] ABSTRACT

An apparatus and method of operating a fluidized bed reactor for combusting refuse derived fuel is disclosed. The reactor includes a fluidized furnace section 30 and stripper/cooler section 80. A downwardly sloping grid 28 extends across the furnace section 30 and stripper/-cooler section 80 to a drain 78 in the stripper/cooler section 80, and directional nozzles 38 disposed in the grid fluidize the beds in the furnace section 30 and stripper/cooler section 80 and forcibly convey relatively large particulate material across the grid 28, through the furnace section 30 and stripper/cooler section 80, and to the drain 78 for disposal. A refractory layer 36 is provided along the grid 28 surface to reduce the height of the nozzles 38 within the furnace section 30, thereby helping to prevent relatively large particulate material from becoming entangled with or stuck to the nozzles 38. The furnace section 30 and stripper/cooler section 80 are designed to provide a relatively straight path for the relatively large particulate material passing from the furnace section 30, to the stripper/cooler section 80, and to the drain 78.

9 Claims, 2 Drawing Sheets

FLUIDIZED BED REACTOR AND METHOD UTILIZING REFUSE DERIVED FUEL

This is a divisional of application Ser. No. 08/064,776, filed on May 11, 1993, now U.S. Pat. No. 5,395,546.

BACKGROUND OF THE INVENTION

This invention relates to a fluidized bed reactor and method of operating a fluidized bed reactor and, more particularly, to such a reactor and method in which the reactor is fueled in whole or in part by refuse derived fuel, or RDF.

Cities across the United States and in other countries are seeking alternatives to landfills for the disposal of municipal solid waste, or MSW. Available landfill space is rapidly decreasing, and costs associated with landfill disposal continue to increase. As a result, some cities are turning to incineration as a means of reducing the amount of MSW which otherwise must be sent to landfills while, at the same time, recovering energy from the waste.

In typical waste-to-energy combustors, solid waste is burned on the surface of a grate or hearth, or in a shallow suspension, just above the grate surface. Consecutive agitation of the waste is minimal and is typically aided by mechanical means. Fluidized bed reactors have been proposed for burning MSW and provide a number of advantages over non-fluidized waste reactors. For example, the high turbulence, and therefore intimate mixing of fuel, air, and hot inert particles in a fluidized bed reactor, can provide for combustion efficiencies exceeding 99% as compared to combustion efficiencies of approximately 97% to 98% in non-fluidized waste combustors. Fluidized bed reactors also provide greater fuel flexibility and enhanced pollution control.

However, fluidized bed reactors used to date have not been without problems. For example, to date, fluidized bed reactors have utilized complex combustion systems which include a moving or traveling grate furnace. These systems have many moving parts and typically burn at an elevated furnace temperature that often results in a high furnace corrosion rate, frequent equipment failure, and low plant availability.

SUMMARY OF THE INVENTION

It is therefore an object of the present invention to provide a fluidized bed reactor and a method of operating a fluidized bed reactor in which RDF may be cleanly and efficiently incinerated without the use of complex combustion systems which include moving or traveling grate furnaces, stoker boilers, or rotary kiln incinerators.

It is a further object of the present invention to provide a reactor and method of the above type in which a stationary, sloping grid is provided across a furnace section and a stripper/cooler section and in which means are provided for directing relatively large, heavy, and/or coarse particulate material from the furnace section to the stripper/cooler section and to a drain in the stripper/cooler section.

It is a still further object of the present invention to provide a reactor and method of the above type in which directional nozzles are used to direct relatively large, heavy, and/or coarse particulate material, which tends to accumulate at the bottom of the furnace section, from the furnace section, to the stripper/cooler section, and to the drain.

It is a still further object of the present invention to provide a reactor and method of the above type in which a protective refractory layer is applied to the sloping grid surface to reduce the exposure of the directional nozzles within the furnace section and the stripper/cooler section to elevated temperatures.

It is a still further object of the present invention to provide a reactor and method of the above type in which the grid and the nozzles are protected from excessive corrosion and in which the risk that relatively large, heavy, and/or coarse particulate material may become entangled in the nozzles is reduced.

It is a still further object of the present invention to provide a reactor and method of the above type in which a thin layer of corrosive resistant refractory is provided to protect the furnace walls in the lower portions of the furnace section, which operates under reducing conditions.

It is a still further object of the present invention to provide a reactor and method of the above type in which a weld overlay of a corrosive resistant high nickel-steel alloy is provided to protect other portions of the furnace section walls from corrosion due to, among other things, chloride attack.

It is a still further object of the present invention to provide a reactor and method of the above type in which selective non-catalytic reduction is used to further lower $NO_x$ levels in flue gases.

It is a still further object of the present invention to provide a reactor and method of the above type in which a heat recovery area is provided in which additional heat from flue gas is recovered and flue gas temperatures are lowered to desired levels.

It is a still further object of the present invention to provide a reactor and method of the above type in which a dry flue gas scrubber treats the flue gas to lower the quantity of acid gases in the flue gas, and a fabric filter baghouse is provided which reduces the quantity of particulate materials in the flue gas to prepare the flue gas for disposal or discharge.

It is a still further object of the present invention to provide a reactor and method of the above type which is fueled in whole or in part by class 3 RDF which is typically processed so that at ,least 85% of the RDF material may pass through a two inch square mesh screen and at least 98% of the RDF material may pass through a 3.25 inch square mesh screen.

Toward the fulfillment of these and other objects, the fluidized bed reactor of the present invention includes a fluidized furnace section and stripper/cooler section. A downwardly sloping grid extends across the furnace section and the stripper/cooler section to a drain in the stripper/cooler section, and directional nozzles disposed in the grid fluidize the beds in the furnace section and stripper/cooler section and forcibly convey large particulate material across the grid, through the furnace section and stripper/cooler section, and to the drain for disposal. A refractory layer is provided along the grid surface to reduce the height of the nozzles within the furnace section, thereby helping to prevent relatively large particulate material from becoming entangled with, or stuck to, the nozzles. The furnace section and stripper/cooler section are designed to provide a relatively straight path for the large particulate material passing from the furnace section, to the stripper/cooler section, and to the drain. The furnace section is operated using two-staged combustion to lower, among other things, $NO_x$ emissions. The stripper/cooler section is operated in a batch mode to flush large particulate material from the furnace section and stripper/-cooler section. A separator, steam generator tube bank, heat recovery area, dry flue gas scrubber, and fabric filter baghouse are used in combination with the furnace section and stripper/cooler section to provide for further combustion efficiency and pollution control and to prepare the flue gas for discharge.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
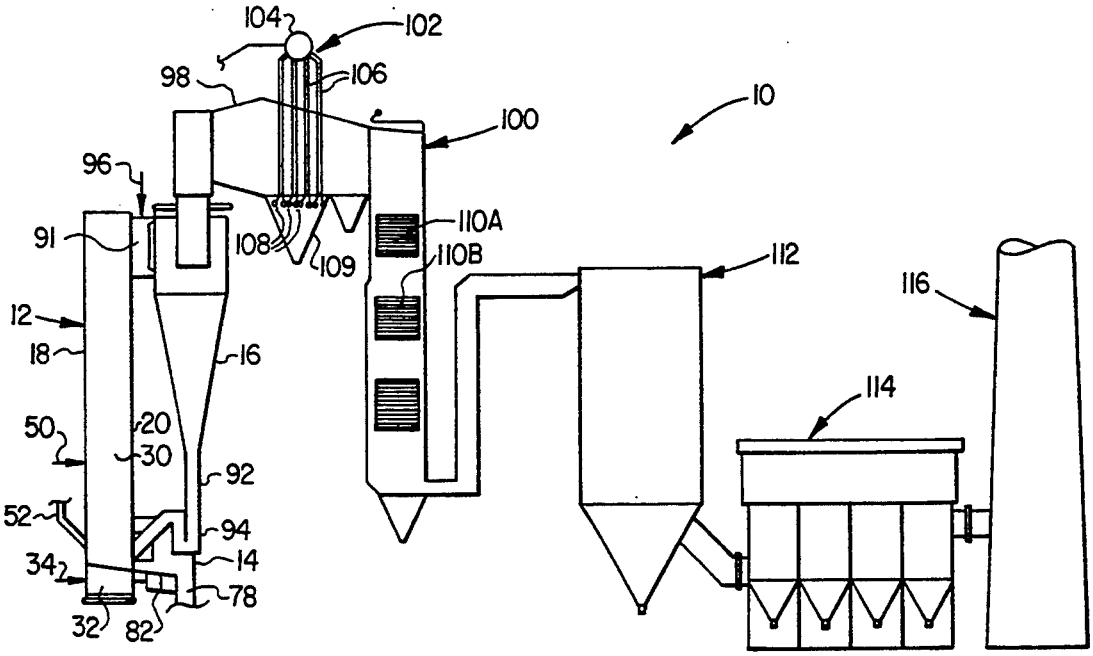
FIG. 1 is a schematic view of a fluidized bed reactor incorporating features of the present invention.

Referring to FIG. 1 of the drawings, the reference numeral 10 refers in general to a fluidized bed reactor of the present invention which includes, inter alia, an enclosure 12, a chamber 14, and a cyclone separator 16. As better shown in FIG. 2, the enclosure 12 has a front wall 18, a rear wall 20, and two sidewalls (not shown). Similarly, the chamber 14 has a front wall 22, a rear wall 24, and a floor 26. Although not clear from the drawings, it is understood that the walls of the enclosure 12, the chamber 14, and the separator 16 are formed by a plurality of spaced parallel tubes interconnected by fins extending from diametrically opposed sides of each tube.

A grid 28 divides the enclosure 12 into a furnace section 30 and a plenum 32. The grid slops downwardly from the front wall 18 of the enclosure 12 to and beyond the rear wall 20 of the enclosure 12 (discussed in more detail below). The plenum 32 is supplied with an oxygen-containing, fluidizing gas, such as air, via an independently regulable duct 34.

Figure 3:
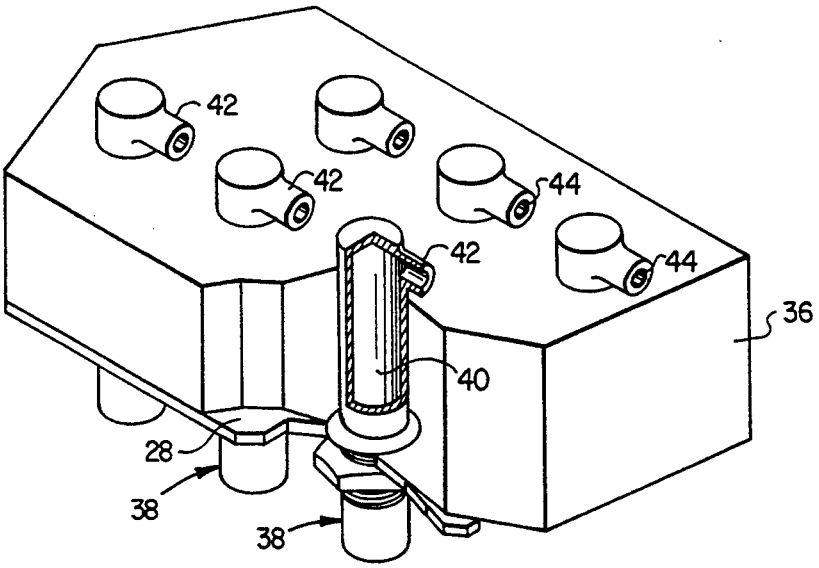
FIG. 3 is an enlarged, partially exploded view of a grid utilized in the reactor of FIG. 1.

A layer of refractory 36 (FIG. 3) is secured to the top surface of the grid 28. A plurality of directional nozzles 38 extend through the grid 28 and refractory 36 for passing fluidizing air from the plenum 32 to the furnace section 30. Each nozzle 38 has a first portion 40 which extends upwardly from within the plenum 32 through the grid 28 and refractory 36 and a second portion 42 which extends substantially horizontally within the furnace section 30. The second portion 42 of the nozzle 38 has a large, single discharge outlet 44 having a diameter of approximately 0.5 inch to 1.0 inch, which is not prone to plugging as are nozzles with multiple small openings.

The directional nozzles 38 in the enclosure 12 are arranged to direct large, heavy, and/or coarse particulate material (hereinafter "relatively large particulate material"), which tends to settle toward the bottom of the furnace section 30, toward an opening 46 (FIG. 2) which is provided in the rear wall 20 of the enclosure 12 at the bottom of the furnace section 30. For reasons to be described, another opening 48 is provided in the rear wall 20 of the enclosure 12, above the opening 46. Although not clear from the drawings, the openings 46 and 48 are formed by bending tubes which form the rear wall 20 of the enclosure 12 out from the plane of the rear wall 20 and omitting a portion of the fins connecting those tubes.

The layer of refractory 36 (FIG. 3) covers substantially all of the first portion 40 of the nozzles 38 to reduce the exposed height of the nozzles 38 within the furnace 30. This reduces the risk that relatively large particulate material may become clogged or jammed due to the presence of the nozzles 38.

For reasons to be described, a duct 50 (FIG. 2) is provided for introducing a secondary, oxygen-containing gas, or overfire air, into the furnace section 30. Although only one duct 50 is shown, it is understood that overfire air may be introduced in a number of different locations and at different levels in the furnace section 30 using any conventional means for introducing the secondary or overfire air.

Figure 2:
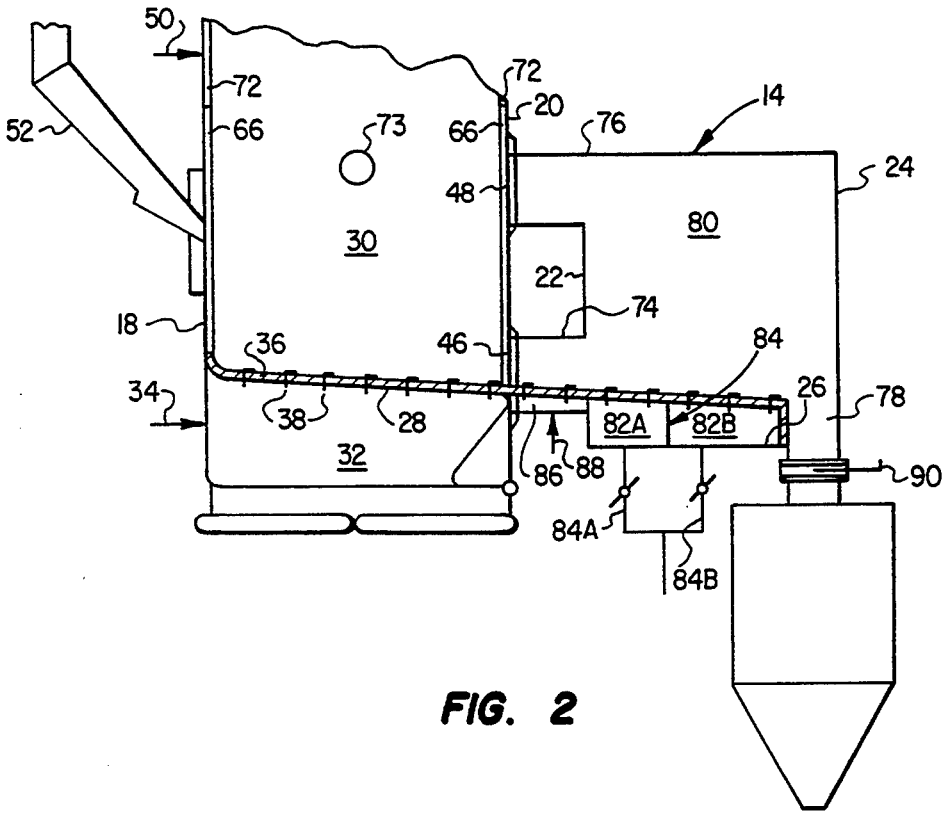
FIG. 2 is an enlarged, schematic view of a portion of the fluidized bed reactor of FIG. 1.
Figure 4:
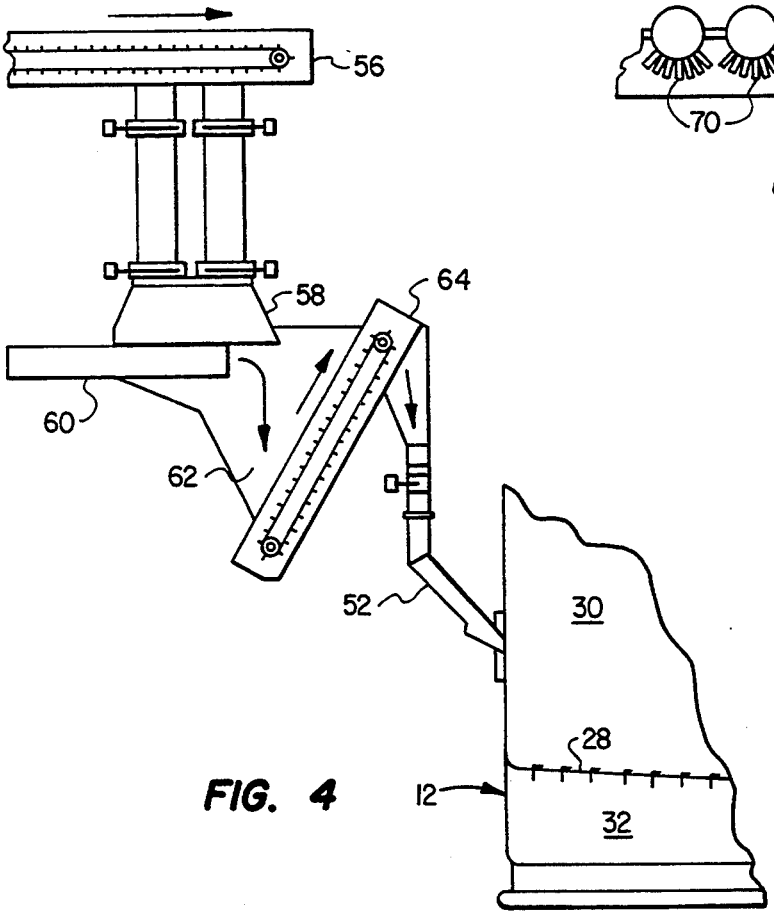
FIG. 4 is a schematic, cross-sectional view of a portion of a furnace wall of the reactor of FIG. 1.

As shown in FIGS. 2 and 4, an air swept fuel spout 52 feeds RDF into the furnace section 30. Relatively uniform feed rates are provided by a feed system designed by Detroit Stoker Co. for handling waste fuels. The system is shown in general by the number 54 (FIG. 4). A conveyor system 56 supplies RDF to a feed bin 58. A hydraulic ram 60 transfers the RDF in a controlled manner to a lower hopper 62 where a steeply sloping apron-type conveyor 64 fluffs the RDF to a relatively uniform density. The conveyor 64 then transfers a portion of the RDF to the air swept fuel spout 52 for introduction into the furnace section 30.

Figure 5:
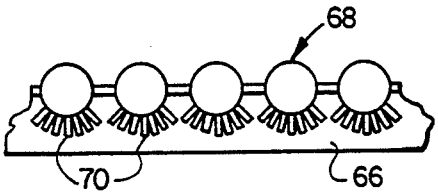
FIG. 5 is an enlarged, schematic view of a portion of an RDF feed system for use in the reactor of FIG. 1.

As will be described below, a lower portion of the furnace section 30 is operated under reducing conditions which enhances the corrosive nature of certain products of combustion. For example, plastics in the RDF feed release chlorides during combustion. Significant concentrations of gaseous chloride compounds at elevated temperatures and in a reducing atmosphere can cause tube metals to corrode rapidly. Accordingly, as seen below and throughout the description of the present invention, a number of steps are taken to protect reactor components from chloride attack, such as protecting tubes and metal surfaces, reducing the chance of a localized reducing atmosphere above the lower portion of the furnace section 30, and lowering tube metal temperatures. In that regard, the walls of the lower portion of the furnace section 30 are provided with a protective layer of high strength, low cement, low porosity refractory 66 (FIGS. 2 and 5). As stated above, the front wall 18, the rear wall 20 and the two sidewalls (not shown) forming the enclosure 12 are formed by a plurality of interconnected finned tubes. The refractory 66 forms a layer that is two inches thick or less and is anchored to the finned-tube walls 68 by a high density stud pattern 70. Remaining portions of the inner walls of the furnace section 30 are protected by a weld overlay 72 of a corrosive resistant high nickel-steel alloy.

As shown in FIG. 2, a supplemental heater 73 is provided through one of the sidewalls of the furnace section 30, for reasons to be described.

The chamber 14 is disposed adjacent to the enclosure 12. The conduits 74 and 76 connect the chamber 14 to the openings 46 and 48, respectively, in the rear wall 24 of the enclosure 12, for reasons to be described. The opening 46 and the conduit 74 are sized to permit relatively large particulate material to pass from the furnace section 30 to the chamber 14.

The grid 28 slopes downwardly from the furnace section 30, through the conduit 74, and across the chamber 14, to a drain 78 disposed in the floor 26 adjacent to the rear wall 24 of the chamber 14. The grid 28 divides the chamber 14 into a stripper/cooler section 80 and a plenum 82. Internal walls, baffles, or partitions are not used in the stripper/cooler section 80 to allow all solids the straightest possible path from the furnace section 30 to the drain 78.

A partition 84 is provided within the plenum 82 and extends upwardly from the floor 26 of the chamber 14 to the grid 28 to divide the plenum 82 into portions 82A and 82B. The portions 82A and 82B are provided with two independently regulable sources 84A and 84B, respectively, of fluidizing air. Similarly, portions of the rear wall 20 of the enclosure 12 and the front wall 22 of the chamber 14 extend upwardly from the floor of the conduit 74 to the grid 28 to define a plenum 86 in the conduit 74. An independently regulable source 88 of fluidizing air is provided to the plenum 86.

The grid 28, the refractory 36, and the nozzles 38 in the conduit 74 and the chamber 14 are substantially identical to those in the enclosure 12, discussed above, and will therefore not be described in detail again. The grid 28 continues its downward slope through the conduit 74 and across the chamber 14 to the drain 78. The directional nozzles 38 in the conduit 74 are arranged to direct the relatively large particulate material which is received from the furnace section 30 into the stripper/-cooler section 80. Similarly, the directional nozzles 38 in the chamber 14 are arranged to direct the relatively large particulate material which is received from the conduit 74 to the drain 78. The drain 78 has a valve 90 that may be opened or closed as desired to selectively drain particulate material from or retain particulate material in the stripper/cooler section 80.

As shown in FIG. 1, the cyclone separator 16 is disposed adjacent to the enclosure 12 and is connected to an upper portion of the enclosure 12 by a conduit 91 for receiving a mixture of hot flue gas and entrained particulate material from an upper portion of the furnace section 30. A dipleg 92 and J-valve 94 connect the separator 16 to a lower portion of the furnace section for returning separated particulate material to the furnace section 30. A duct 96 is connected to the conduit 91 for introducing a selective non-catalytic reducing agent, such as ammonia or urea, into the mixture of hot flue gas and particulate material passing through the conduit 91 for lowering $NO_x$ levels in the flue gas. Although the duct 96 depicted injects the selective non-catalytic reducing agent upstream of the separator 16 into one location of the conduit, it is understood that the agent may be injected at more than one location along the conduit and/or directly into the separator 16.

Although not clear from the drawings, it is understood that the walls of the separator 16 are also formed by finned tubes similar to the finned-tube walls 68 (FIG. 5) of the enclosure 12. Similar to the furnace section 30, the inner surfaces of the separator 16 are also covered with a protective, two-inch thick or less layer of a high strength, low cement, low porosity refractory, also retained on studs with a high density pattern.

A conduit 98 (FIG. 1) connects the separator 16 to a heat recovery area 100 for passing the separated flue gas from the separator 16 to the heat recovery area 100. A steam generator tube bank shown in general by the number 102 is provided for cooling flue gas passing from the separator 16 to the heat recovery area 100. The steam generator tube bank 102 includes a steam drum 104, a plurality of cooling tubes 106, and a plurality of headers 108. The cooling tubes 106 extend downwardly from the steam drum 104 and through holes provided in the top walls of the conduit 98 so that the cooling tubes 106 extend in the path of the flue gas passing through the conduit 98. The headers 108 are disposed below the conduit in a hopper 109 connected to the conduit 98 and extending below the tubes 106 and headers 108. The headers 108 are sized to permit debris and deposits to be removed therefrom using mechanical rappers (not shown) which strike the ends of the headers 108 and thereby induce vibrations of the headers 108 and the tubes 106. Flexible feeders (not shown) connect the headers 108 to downcomers (not shown) which are in turn connected to other portions of the fluid flow circuitry of the reactor 10.

The cooling tubes 106 are arranged in a plurality of rows. Although it is not clear from the drawings, the headers 108 are arranged in a plurality of rows of axially-aligned pairs. The rows of headers 108 are aligned substantially parallel with the steam drum 104, and each row of headers 108 is connected to a row of coolings tubes 106.

The conduit 98 is connected to a heat recovery area 100 which includes a finishing superheater 110A and an economizer 110B. Additional heat exchange surfaces may be disposed within the heat recovery area 100, as desired. The finishing superheater 110A and economizer 110B are disposed in the path of the flue gas passing through the heat recovery area 100 for further cooling the flue gas and transferring more heat to the cooling fluid circulating through the fluid flow circuitry of the reactor 10.

A dry flue gas scrubber 112 is connected to the heat recovery area 100 for receiving the cooled flue gas and neutralizing acid components of the flue gas, such as sulfur dioxides, hydrochloric acid, and hydrofluoric acid. A fabric filter baghouse 114 is connected to the scrubber 112 for removing particulate material remaining in the flue gas, such as flyash, scrubber reaction products, and unreacted lime (introduced in the scrubber 112 as will be described). The baghouse 114 is connected to a stack 116 for disposal or discharge of the treated flue gas into the atmosphere.

In operation, the quality of the RDF fed to the reactor 10 will affect the overall performance of the reactor. As described below, municipal solid waste, or MSW, is therefore first treated to create RDF of the desired size and consistency. There are five general classes of RDF quality that are currently commercially produced. Table 1, below, summarizes these classes.

TABLE 1

CLASSIFICATION OF REFUSE DERIVED FUELS

| Class | Form | Description |
|---|---|---|
| RDF-1 | Raw (MSW) | Municipal solid waste as a fuel as discarded but without oversized bulky wast |
| RDF-2 | Coarse (CRDF) | MSW processed to coarse particle size with or without ferrous-metal separation, such that 95% by weight passes through a 6 inch square mesh screen |
| RDF-3 | Fluff | Shredded fuel derived from MSW processed |

TABLE 1-continued

| CLASSIFICATION OF REFUSE DERIVED FUELS | | |
|---|---|---|
| Class | Form | Description |
| | (fRDF) | for the removal of metal, glass and other entrained inorganics; particle size of thi material is such that it has at least 85% passing through 2 inches and 98% passing through 3¼ inches. |
| RDF-4 | Powder (pRDF) | Combustible waste fraction processed into powdered form, 95% by weight passing through a 2000 micron screen size |
| RDF-5 | Densified (dRDF) | Combustible waste fraction densified (compressed) into pellets, slugs, cubettes briquettes, or similar forms |

MSW is treated by various combinations, quantities, and qualities of metal separating, screening, and shredding equipment to obtain the desired quality or class of RDF. In general, the greater the number of stages of metal separation, screening, and shredding, the better the quality and size distribution of the RDF. Referring to Table 1, densified RDF, RDF-5, is the highest grade of RDF that is currently commercially produced. Almost all of the commercially available combustion systems can be designed or modified to burn RDF-5 without significant modifications. However, the cost of ]producing RDF-5 is several times higher than the cost of preparing RDF-1, RDF-2, or RDF-3. Class 3 RDF, or RDF-3, costs much less to produce and may be used effectively in the system of the present invention. In contrast, significant: modifications would be required to enable commercially available combustion systems to use RDF-3 effectively.

To prepare RDF-3 for use in the present reactor 10, raw MSW is delivered to a tipping floor where white goods and other unprocessable waste is separated and where the remaining MSW is fed to in-feed conveyors. Packing station personnel remove any additional unacceptable or unprocessable waste.

A primary trommel opens trash bags, breaks glass, and removes material under 5.5 inches in size. The fraction of MSW not removed by the primary trommel is shredded using a horizontal hammermill so that at least 85% of the material passes through a two-inch square mesh screen and at least 98% passes through a 3.25-inch square mesh screen, to create class 3 RDF.

The material removed by the primary trommel is conveyed to a two-stage secondary trommel screen for recovery of a glass/organic fraction, a fueled fraction, and an aluminum fraction. The glass/organic fraction, which typically comprises approximately 20% of the MSW throughput, is conveyed to a glass recovery system for further processing, the fuel fraction is conveyed either to the shredder or directly to RDF storage, and the aluminum rich fraction is conveyed to an eddy current aluminum separation system for recovery of approximately 60% of the aluminum cans.

Each of the two processing lines incorporates several overhead belt magnets strategically located for recovery of approximately 92% of the ferrous metals. The result of the above processing should yield a fuel having approximately the following characteristics:

| Constituent | Percent | Range |
|---|---|---|
| Carbon | 33.83 | 25.06–38.37 |
| Hydrogen | 4.35 | 3.22–4.94 |
| Sulfur | 0.19 | 0.19–0.27 |
| Oxygen | 25.61 | 18.97–29.06 |

-continued

| Constituent | Percent | Range |
|---|---|---|
| Moisture | 21.10 | 15.00–35.00 |
| Nitrogen | 0.97 | 0.97–1.48 |
| Ash | 13.95 | 11.31–16.00 |
| | 100.00 | |
| Higher Heating Value | 6170 Btu/Lb | 4500–7000 |
| | 3428 Kcal/Kg | 2500–3900 |

During fuel preparation, approximately 25% of the raw MSW will typically be separated for recycling and 75% will be converted to RDF-3 for fueling the reactor 10. Typically, only the reactor waste will be landfilled, which often amounts to only approximately 15% of incoming raw MSW.

In operation, the conveyor 56 supplies the processed RDF-3 fuel to feed bin 58. The hydraulic ram 60 compresses and transfers the RDF in a controlled manner to the hopper 62. The apron conveyor 64 fluffs the RDF to a relatively uniform density and delivers controlled amounts of the RDF to the air swept fuel spout 52, which injects the RDF into the furnace section 30. Because RDF ash is typically too fine or too coarse to provide suitable bed material, inert bed materials, such as sand, may also be provided to the furnace section 30 to help stabilize combustion by providing proper bed turbulence and significantly more heat-radiating surface area within the furnace section 30.

An oxygen-containing, fluidizing gas, such as air, is introduced from the duct 34, through the plenum 32 and into the furnace section 30 to fluidize the particulate material, including the RDF and inert bed materials, in the furnace section 30. As discussed in more detail below, the directional nozzles 38 also act to direct relatively large particulate material down the sloping grid to the opening 46 and the conduit 74.

The RDF is combusted in the furnace section 30. The oxygen supplied by the fluidizing air is limited to an amount less than the stoichiometric amount theoretically required for complete combustion of the RDF, creating a reducing atmosphere in a lower portion of the furnace section 30. Additional oxygen or overfire air is provided through duct 50 located above the fluidized bed. The duct 50 provides more than the stoichiometric amount of oxygen theoretically required for complete combustion of the RDF so that the upper portion of the furnace section 30 operates under oxidizing conditions. To assure complete combustion and minimize the occurrence of any localized reducing conditions in the upper portion of the furnace section 30, 50% excess air is provided.

The reducing atmosphere in the lower portion of the furnace section 30, and the relatively low combustion temperatures (1500°–1700° F.) act to lower $NO_x$ emissions in flue gas exiting the furnace section 30. It is preferable that limestone not be added into the furnace section 30 for sulfur control, because the addition of limestone enhances $NO_x$ formation, and hydrochloric acid emissions are difficult to control with limestone due to the temperatures in the furnace section 30.

In the furnace section 30, hot flue gas entrains a portion of the particulate material in the furnace section 30, and this mixture of hot flue gas and entrained particulate material passes from the furnace section 30 to the separator 16. A selective non-catalytic reducing agent, such as ammonia or urea, is added to the mixture of hot flue gas and particulate material in the conduit via the duct 96 to lower $NO_x$ levels in the flue gas. The separator 16 then operates in a conventional manner to separate the particulate material from the flue gas and to reintroduce the separated particulate material into the furnace section 30 via the dipleg 92 and the J-valve 94.

The finned-tube walls of the separator 16 are cooled with steam directly from the steam drum 104. The temperature of the walls of the separator 16 is only slightly higher than the temperature of the walls of the enclosure 12. Therefore, expansion of the separator walls is similar to that of the walls of the furnace section 30, and the separator is considered an integral part of the furnace section 30.

The high turbulence created in the furnace section 30 and enhanced by the recycle from the separator 16 creates a thermal inertia or "thermal flywheel effect" that provides for more stable combustion. The fluidized bed allows more material to reside in the furnace section 30 at any given time, and the large thermal mass and extra turbulence greatly reduce the potential for cold or hot spots to occur in the furnace section 30, in turn reducing the potential for stratified pockets of poor combustion to occur.

The low combustion temperatures and reducing atmosphere in the lower portions of the furnace section 30 provide for $NO_x$ emissions that are typically in the range of 150–200 ppmv. This compares favorably to $NO_x$ concentrations of 200–350 ppmv typically achieved with conventional combustion. The reactor 10 can also achieve a boiler efficiency of better than 81%, due to the low excess air (50%) and the low unburned carbon (typically 1% or less). This also compares favorably with boiler efficiencies of approximately 70% for conventional combustors that burn untreated MSW and approximately 75% for conventional RDF combustors. Also, the flexibility in controlling heat exchange rates in the reactor 10 gives the reactor 10 superior turn down capability, permitting loads ranging between approximately 50% to 100% with little change in combustion gas temperature.

Despite these advantages and the superior fuel flexibility of the reactor 10, variations in the heating value and moisture content of RDF generated from MSW can still cause difficulties in maintaining a desired bed temperature. Accordingly, the supplemental heater 73 is provided in the furnace section 30 to provide additional heat, when needed, for maintaining a desired temperature in the furnace section 30. Supplemental heat may be provided by such sources as in-bed lances, freeboard burners, and/or an in-duct burner.

During operation and fluidization of the furnace section 30, relatively large particulate material tends to settle at the bottom of the furnace section 30 on or near the grid 28. Although RDF-3 is processed so that at least 98% of the material passes through a 3.25 inch square mesh screen, objects of many times that size in one dimension can be expected to get through the fuel processing system. Things such as oversized pieces of brick or metal or long pieces of wire (also referred to hereinafter as "relatively large particulate material") can make it through the fuel processing system. If present in high quantity, this relatively large particulate material can cause localized defluidization and hot spots. Further, this relatively large particulate material may become entangled with or caught on nozzles of typical combusters.

To avoid these problems, the furnace section 30, the conduit 74, and the stripper/cooler section 80 are designed to facilitate the quick and efficient removal of such relatively large particulate material as will be described. The directional nozzles 38 in the furnace section are disposed so that substantially horizontal jets of fluidizing air forcibly convey the relatively large particulate material down the sloped grid 28 to the conduit 74. Similarly, the nozzles 38 in the conduit 74 and in the stripper/cooler section 80 force the relatively large particulate material from the conduit 74 and across the stripper/cooler section 80 to the drain 78. Relatively large particulate material is removed via the drain 78 for disposal. The directional nozzles 38 permit the relatively large particulate material to be forcibly conveyed to drain 78 before they can accumulate, defluidize, overheat, or fuse as large masses.

Because the stripper/cooler section 80 is comprised of a single compartment without baffles or partitions, the stripper/cooler section 80 is operated in a batch mode. In the batch mode, the stripper/cooler section 80 begins each cycle substantially empty. The flow of particulate material, including relatively large particulate material, from the furnace section 30 to the stripper/cooler section 80 is begun by introducing fluidizing air from source 88 and plenum 86 into the conduit 74. When the stripper/cooler section 80 is filled with the desired amount of particulate material, including relatively large particulate material, the fluidizing air to the conduit 74 and, hence, the flow of particulate material from the furnace section 30 to the stripper/cooler section 80 is stopped.

At this point, the stripping of the relatively fine particulate material from the relatively large particulate material in the stripper/cooler section 80 by fluidizing air from plenum portions 82A and 82B takes place until such relatively fine particulate material is depleted to the desired extent. Portions of this relatively fine particulate material are returned to the furnace section 30 via the conduit 76 and the opening 48 in the rear wall 24 of the enclosure 12. Also, residual carbon in the relatively fine particulate material is combusted while temperatures remain above the combustion temperature. The fluidizing air from plenum portions 82A and 82B also act to cool the remaining relatively large particulate material, in the stripper/cooler section 80. The use of the plenum portions 82A and 82B and independently regulable sources of fluidizing air 84A and 84B provides flexibility as to the stripping and cooling functions in the stripper/cooler section 80.

When the particulate material in the stripper/cooler section 80 falls to a desired disposal temperature, the valve 90 of the drain 78 is opened, and the particulate material, including relatively large particulate material, is removed via the drain 78 for disposal. The batch process is then repeated.

The time required for one entire batch cycle is typically in the order of 30 minutes. The duration and cycle frequency will of course vary depending on the boiler load and the type and composition of the fuel being fired. Because the filling and cycle time is relatively short, the rate of transfer of solids from the furnace section 30 to the stripper/cooler section 80 is several times that of the average bottom ash drain rate. This results in a flushing of relatively large particulate material from the furnace section 30, the conduit 74, and the stripper/cooler section 80 to the drain 78 for disposal. This flushing action prevents the accumulation of large particulate material in the furnace section 30, the conduit 74, or the stripper/cooler section 80.

With reference to FIG. 1, the separated hot flue gas passes from the separator 16 into conduit 98. Because chloride corrosion is a function of tube metal temperature, and because tube metal temperatures of the finishing superheater 110A are relatively high, the steam generator tube bank 102 is provided to lower the temperature of the flue gas before it passes to and over the finishing superheater 110A. At temperatures above approximately 1250° F., the flue gas would tend to cause excessive corrosion of the tube surfaces of the finishing superheater 110A due to acid attack from compounds such as chlorides. In that regard, the hot flue gas passes through the conduit 98 and past the cooling tubes 106 to cool the hot flue gas to below 1250° F. before passing to the heat recovery area 100.

Some particulate material remains entrained in the hot flue gas as it enters the conduit 98 and passes across the cooling tubes 106. A portion of this particulate material strikes and adheres to the cooling tubes 106 forming deposits which can decrease heat exchange rates across the cooling tubes 106. The deposits can also lead to clogging which obstructs the path of the flue gas and increases pressure drop across the steam generator tube bank 102. As discussed above, mechanical rappers (not shown) are used to rap the headers 108 to induce vibration of the headers 108 and tubes 106 which dislodges deposits formed on the tubes 106. Mechanical rappers are preferred over steam sootblowers because the mechanical rappers tend to leave a protective layer of ash deposit on the cooling tubes 106 which reduces corrosion associated with chloride attack. In contrast, steam sootblowers have been found to accelerate tube wastage or corrosion in plants firing high chlorine fuels, likely due to the removal of the protective layer of ash deposit.

After passing over the steam generator tube bank 102 in the conduit 98, the cooled flue gas then passes to the heat recovery area 100, first crossing the finishing superheater 110A, then the primary superheater 110B and the economizer 110C. To provide for lower tube metal temperatures, cooling fluid in the finishing superheater 110A is in parallel flow with the flue gas. The tubes of the superheater 110A, the primary superheater 110B and the economizer 110C are designed to provide large, clear spacing with a low inter-tube velocity to minimize any accumulation of deposits of particulate material. Nonetheless, the superheater 110A is also provided with mechanical rappets to remove unwanted deposits. The flue gas exits the heat recovery area 100 at approximately 425° F.

The cooled flue gas exits the heat recovery area 100 and passes to the dry flue gas scrubber 112. A lime slurry is atomized and injected into the scrubber 112 to neutralize acid gas components of the flue gas (primarily sulphur dioxides, hydrochloric acid, and hydrofluoric acid). The water in the slurry is evaporated by the hot flue gas producing dry powder reaction products. Additionally, small qualities of activated carbon are mixed with the lime slurry and sprayed into the scrubber 112 to further lower emissions of certain trace heavy metals, dioxins, and organic compounds. The treated and cooled flue gas then exits the scrubber 112 at approximately 275° F. and passes to the fabric filter baghouse 114.

In the baghouse 114, the remaining particulate material, consisting primarily of flyash, dry scrubber reaction products, and unreacted lime, is collected on an array of fabric filter bags as contained in multiple modular units. Collected material is periodically removed from the bags using pulses of compressed air flowing in reverse to the normal flue gas flow.

The treated and cooled flue gas then passes to the stack 116 for disposal or discharge to the atmosphere.

Several advantages result from the foregoing apparatus and method. For example, the present apparatus and method permits a fluidized bed reactor to be used to cleanly and efficiently burn RDF without the use of complex combustion systems which include moving or traveling grate furnaces, stoker boilers, or rotary kiln incinerators which are more prone to mechanical problems and failures. The use of a sloped grid 28 surface and directional nozzles 38 efficiently conveys relatively large particulate material across the furnace section 30, the conduit 74, and the stripper/cooler section 80 to the drain 78 before the relatively large particulate material accumulates in the system and causes problems such as defluidization, hot spots, or blockage of various outlets, conduits, or drains. Additionally, the use of a protective refractory layer 36 in the lower furnace section 30 and in the separator 16 and a protective weld overlay 72 in the upper portion of the furnace section 30 protects the reactor 10 against excessive corrosion due to chloride attack. Further, the reactor 10 provides for more stable, efficient, and complete combustion than conventional waste-to-energy incinerators, while at the same time providing superior flexibility and pollution control.

It is understood that variations may be made in the above-described preferred embodiment without departing from the scope of the present invention. For example, although the reactor 10 is described as burning class 3 RDF, it is understood that other classes of RDF as well as MSW or other fuels may be fired in the reactor 10. Also, the pollution control devices and techniques disclosed may be used in any number of combinations or may be deleted or replaced with other devices or techniques, depending upon such things as the fuel being fired and the types and degrees of pollution control desired. For example, two-stage combustion need not be utilized in the furnace section 30, and, similarly, selective non-catalytic reduction may be omitted and/or replaced with other pollution control methods. Additionally, although the stripper/cooler section 80 is preferably operated in a batch mode, the stripper/cooler section 80 may also be operated under continuous or other modes.

A latitude of modification, change and substitution is intended in the foregoing disclosure, and in some instances some features of the invention will be employed without a corresponding use of other features. Various modifications to the disclosed embodiment as well as alternative applications of the invention will be suggested to persons skilled in the art by the foregoing specification and drawings. Accordingly, it is appropriate that the appended claims be construed broadly and in a manner consistent with the scope of the invention therein.

What is claimed is:

1. A method of operating a fluidized bed reactor comprising:

introducing a refuse derived fuel including relatively large material and particulate material into a furnace;

passing a portion of said relatively large material and said particulate material from said furnace to a stripper and cooler;

temporarily discontinuing said step of passing after a predetermined mount of said material passes to said stripper and cooler;

stripping some of the particulate material from the relatively large material in said stripper and cooler;

cooling said relatively large particulate material in said stripper and cooler;

then draining said cooled, relatively large material from said stripper and cooler; and then resuming the step of passing.

2. The method of claim 1 wherein said step of stripping comprises the step of introducing gas into said stripper and cooler in a manner to fluidize said material and entrain said latter particulate material.

3. The method of claim 1 wherein said step of cooling comprises the step of introducing a gas into said stripper and cooler in a manner to fluidize said material and entrain said latter particulate material.

4. The method of claim 1 further comprising the step of introducing gas into said stripper and cooler in a manner to fluidize said particulate material to cause said stripping and cooling.

5. The method of claim 1 wherein said step of passing comprises the steps of introducing gas into said furnace and directing said gas towards said stripper and cooler to promote the flow of said material from said furnace to said stripper and cooler.

6. The method of claim 4 or 5 wherein said gas is introduced substantially horizontally into said furnace and said stripper and cooler.

7. The method of claim 6 wherein said gas is an oxygen-containing gas which is introduced into said furnace in an amount which is stoichiometrically insufficient for complete combustion of said fuel, thereby creating reducing conditions in a lower portion of said furnace; and further comprising the step of introducing additional oxygen-containing gas into said furnace at a level above said fluidized material for supplying more oxygen than is stoichiometrically required for complete combustion of said fuel, thereby creating oxidizing conditions in the upper portion of said furnace.

8. The method of claim 1 further comprising:

discharging a mixture of flue gas and entrained particulate material from an upper portion of said furnace;

injecting a selective non-catalytic reducing agent into said discharged mixture of flue gas and entrained particulate material for lowering levels of $NO_x$ in said flue gas;

separating said particulate material from said flue gases; and returning at least a portion of said separated particulate material to said furnace.

9. The method of claim 1 wherein said selective non-catalytic reducing agent is selected from the group consisting of ammonia and urea.

* * * * *